US007077200B1

(12) United States Patent
Adnan et al.

(10) Patent No.: US 7,077,200 B1
(45) Date of Patent: Jul. 18, 2006

(54) DOWNHOLE LIGHT SYSTEM AND METHODS OF USE

(75) Inventors: Sarmad Adnan, Sugar Land, TX (US); Michael G. Gay, Dickinson, TX (US); Micheal H. Kenison, Missouri City, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 11/102,036

(22) Filed: Apr. 8, 2005

Related U.S. Application Data

(60) Provisional application No. 60/564,857, filed on Apr. 23, 2004.

(51) Int. Cl.
*E21B 41/00* (2006.01)

(52) U.S. Cl. ..... 166/250.01; 250/227.14; 175/41

(58) Field of Classification Search ..... 166/254.3, 166/64, 250.01; 73/152.14; 175/41
See application file for complete search history.

(56) References Cited

U.S. PATENT DOCUMENTS

| | | | | |
|---|---|---|---|---|
| 4,162,400 | A | 7/1979 | Pitts, Jr. | 250/256 |
| 4,346,478 | A * | 8/1982 | Sichling | 398/107 |
| 4,525,874 | A * | 6/1985 | Baues | 398/168 |
| 5,485,745 | A | 1/1996 | Rademaker et al. | 73/151 |
| 6,268,911 | B1 * | 7/2001 | Tubel et al. | 356/72 |
| 6,281,489 | B1 * | 8/2001 | Tubel et al. | 250/227.14 |
| 6,450,257 | B1 | 9/2002 | Douglas | 166/250.02 |
| 6,531,694 | B1 | 3/2003 | Tubel et al. | 250/227.14 |
| 2002/0109080 | A1 * | 8/2002 | Tubel et al. | 250/227.14 |
| 2003/0010495 | A1 * | 1/2003 | Mendez et al. | 166/255.1 |
| 2003/0131990 | A1 * | 7/2003 | Tubel et al. | 166/250.01 |

FOREIGN PATENT DOCUMENTS

| | | |
|---|---|---|
| FR | 2745847 | 9/1997 |
| GB | 2392462 | 3/2004 |

* cited by examiner

*Primary Examiner*—David Bagnell
*Assistant Examiner*—Nicole A Coy
(74) *Attorney, Agent, or Firm*—Robin Nava; Tim Curington

(57) ABSTRACT

A light generating system for use in a wellbore comprising a light generating transducer in the wellbore, the light generating transducer adapted to transform a physical state of a parameter in the wellbore to optical energy; recording equipment sensitive to optical energy to record a physical state; and an optical waveguide for conveying the optical energy from the light generating transducer to receiving equipment. Methods for generating optical energy in a wellbore and methods for measuring parameters in a wellbore using optical energy are also provided.

20 Claims, 3 Drawing Sheets

DOWNHOLE LIGHT SYSTEM AND METHODS OF USE

This application claims the benefit of U.S. Provisional Application No. 60/564,857 filed Apr. 23, 2004.

BACKGROUND OF THE INVENTION

1. Field of the Invention

The present invention relates generally to oilfield operations and more particularly methods and apparatus using fiber optics in coiled tubing operations in a wellbore.

2. Description of Related Art

Casing collar locator (CCL) tools, resistivity tools, and spinner tools are known in the oilfield industry and are used commonly in wireline applications. The use of coiled tubing as a different type of wellbore conveyance in wellbore applications is increasing, resulting in a need for downhole apparatus and methods adapted for use with coiled tubing. Difficulties inherent with using downhole electromechanical apparatus with coiled tubing are the lack of power to the downhole apparatus and the lack of telemetry from the downhole apparatus to the surface; both of these functions are performed by wireline in conventional wellbore applications. To address these difficulties, it is known to install electrical wireline in coiled tubing. Although adding wireline to coiled tubing operations increases the functionality of the coiled tubing, it also increases the cost of the coiled tubing string and complicates field operations. The addition of wireline to a coiled tubing string significantly increases the weight of a coiled tubing string. Installation of the wireline into the coiled tubing string is difficult and the wireline is prone to bunch into a knotty mass or "bird nest" within the coiled tubing. This, and the relatively large outer diameter of wireline compared to the internal diameter of coiled tubing, can undesirably obstruct the flow of fluids through the coiled tubing, such flow through the coiled tubing frequently being an integral part of the wellbore operation.

It is also known to use fiber optics to make downhole measurements by providing optical power at the surface to the fiber optics and using that optical power to generate motive power in a wellbore. For example, U.S. Pat. No. 6,531,694, incorporated herein by reference, discloses a fiber optic system comprises an optical power source at the surface and a fiber optic loop from the surface down the wellbore and back up the wellbore. The optical power from the surface light source is disclosed to power a downhole light cell, which in turn generates electricity to trickle charge batteries in the wellbore. Similar to power being sent downhole, measurements and borehole information may be conveyed to the surface via the fiber optic system. What is not disclosed, however, is the using the measurement of downhole elements to generate energy to send measurements or information to the surface via fiber optics.

Others have attempted to generate power downhole instead of relying on a power source at the surface. It is known to use batteries downhole for power; for example, one existing tool uses six to twelve feet of batteries. Such configurations are accompanied by operational constraints and difficulties. What is needed is a system and method for making downhole measurements with coiled tubing, and communicating those measurements to recording devices on the surface, but without an extensive external power source for the downhole measuring equipment, and without the weight of electrical wireline. Furthermore, what is needed is a device that uses sufficiently small amounts of supplemental power, that such power can be supplied by small batteries that would extend the length of the tool by as little as two inches.

BRIEF SUMMARY OF THE INVENTION

A light generating system for use in a wellbore comprises (a) a light generating transducer in the wellbore, the light generating transducer adapted to transform a physical state of a parameter in the wellbore to optical energy; (b) recording equipment sensitive to optical energy to record a physical state; and (c) an optical waveguide for conveying the optical energy from the light generating transducer to the recording equipment.

In another feature of the system of the present invention, the electrical pulse generated when taking a downhole measurement also powers a light source that communicates via optical fiber to a detector at the surface. In another preferred feature of the system of the present invention, common to all embodiments of the invention, it is a passive system, in that it uses no external power source. However, an alternate method of generating the electrical power may further utilize a small downhole device, such as a bias battery or a circuit, to power the light source, to generate a downhole electrical pulse, or to supplement the electrical pulse generated by taking a downhole measurement. One method may use a bias battery in conjunction with the electrical pulse generated by the measurement to power the light source. Another method may use a small, minimum component circuit in which the electrical pulse generated by the taking a downhole measurement is amplified to power the light source. A third alternate embodiment may use a small circuit by which an electrical pulse generated by the downhole measurement triggers a small downhole electrical pulse to power the light source.

In one embodiment a fiber optic based casing collar locator is provided. The voltage generated when the casing collar locator passes a metallic anomaly, such as a casing collar, in the tubing or casing string, is used to power a downhole light source, which then sends a light signal into an optical fiber that is connected to a measuring and recording device at the surface of the ground. In another embodiment, a fiber optic based resistivity tool is provided that distinguishes between water and oil at the tool location. The downhole fluid is used as an electrolyte in a galvanic cell. When the fluid is conductive, such as water, then the circuit will be closed, and a known voltage created across the light source, which will then send a light signal to the surface. In yet another embodiment, a fiber optic based spinner is provided which uses fluid flow in the wellbore. The spinner uses a downhole light source to generate light pulses at a frequency related to the velocity of the fluid flowing past the spinner. The rotation of the spinner generates the electricity required to power the light source. In an alternate embodiment of this third preferred embodiment, the intensity of the light pulses are modulated, instead of the frequency of the light pulses. The light pulses have the added benefit of enabling quadrature to discern the direction of rotation. In still another alternate embodiment of this third preferred embodiment, both intensity and frequency are modulated.

DETAILED DESCRIPTION OF THE INVENTION

The present invention in its broad aspects is a light generating system for use in a wellbore and methods of use thereof. The invention comprises measurement equipment sensitive to optical energy to measure record a physical state and a light generating transducer in the wellbore, the light generating transducer adapted to transform a physical state of a parameter in the wellbore to optical energy. Often the invention comprises an optical waveguide for conveying the optical energy from the light generating transducer to receiving equipment. The optical waveguide may be, for example, one or more optical fibers, the fibers being single or multimode fibers. The waveguide may be fluid filled.

In some embodiments, the invention provides a method for measuring parameters in a wellbore and communicating the measurements, the method including providing a light generating transducer in the wellbore, the light generating transducer adapted to transform a physical state of a parameter in the wellbore to optical energy; transforming the physical state of a parameter in the wellbore to optical energy; and conveying the optical energy from the light generating transducer by means of an optical waveguide to receiving equipment.

In some embodiments, the invention provides a method for generating optical energy in a wellbore, the method including conveying into a wellbore measurement equipment sensitive to optical energy for measuring a physical state; measuring a physical state of a parameter using the conveyed equipment; and using a light generating transducer to transforming the measurement of the physical parameter to optical energy; wherein the step of transforming is powered by the measurement of the physical parameter. In some embodiments, coiled tubing is used to convey the wellbore measurement equipment into the wellbore, and in some further embodiments, the optical energy is conveyed to receiving equipment using an optical waveguide disposed within the coiled tubing.

As way of example and not limitation, specific embodiments of the light generating system of the present invention are described. Each of these embodiments include measurement equipment sensitive to optical energy to measure a physical state; a light generating transducer in the wellbore, the light generating transducer adapted to transform the measurement of a physical state of a parameter in the wellbore to optical energy; and an optical waveguide for conveying the optical energy from the light generating transducer to receiving equipment.

Figure 1:
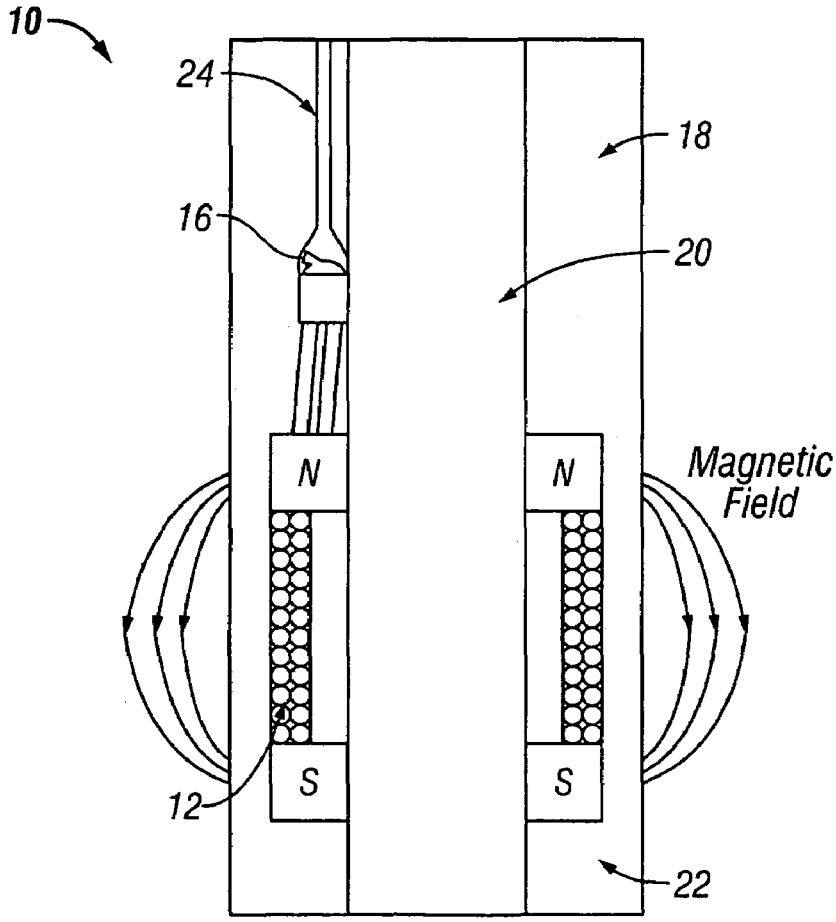
FIG. 1 is a schematic diagram of a fiber optic casing collar locator.

Referring now to FIG. 1, an embodiment is shown in which a change in the physical properties of a parameter is measured and transformed into optical energy, and in particular a casing collar locator 10 is shown as a light generating transducer. The voltage generated when casing collar locator 10 passes a metallic anomaly, such as a casing collar, in the tubing or casing string, is used to power a downhole light source, which then sends a light signal into an optical fiber that is connected to a measuring and recording device at the surface of the ground. The casing collar locator 10 of FIG. 1 comprises a housing 18 having an optional flow passage 20 extending therethrough. Such an optional flow passage particularly is useful when the casing collar locator is deployed on coiled tubing. A coil 12, connected to a light source 16 is disposed in annular space 22 located between the housing 18 and the flow passage 20. An optical waveguide 24 connects light source 16 to receiving equipment. In particular embodiments, the receiving equipment may be disposed at the surface and may contain recording equipment. In some embodiments, optical waveguide 24 may comprise an optical fiber, and in some embodiments, optical waveguide 24 may be fluid filled. Optical energy from the light generating transducer (shown in FIG. 1 as casing collar locator 10) is conveyed via waveguide 24 to receiving equipment (not shown).

Figure 2:
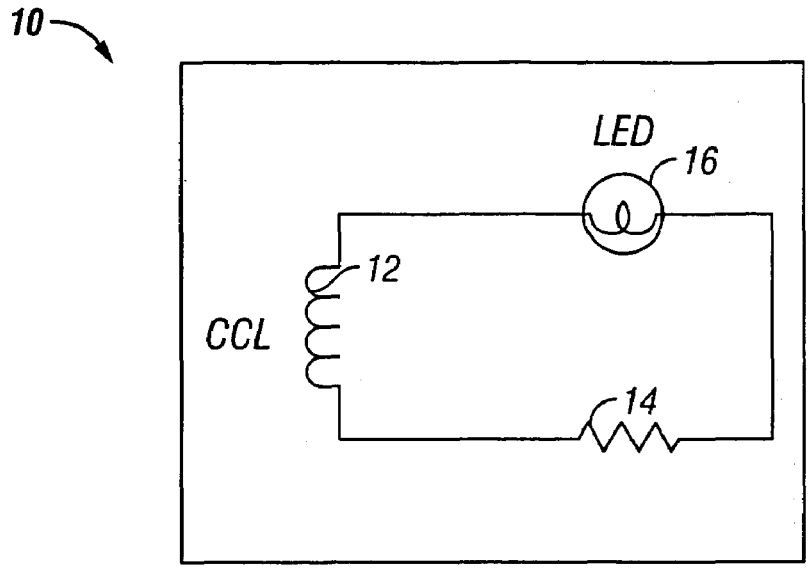
FIG. 2 is a circuit diagram of a fiber optic casing collar locator.

Referring now to FIG. 2, a circuit diagram is shown for casing collar locator illustrated in FIG. 1. The casing collar locator 10 comprises a coil 12, a resistor 14, and a light source 16. In specific embodiments, the resistor may be a 40-ohm resistor. The light source may be any suitable source such small low power laser, a velocity cavity surface emitting laser (VCSEL), or an available LED light source such as a GaAlAs LED commercially available from Optek Technology.

When casing collar locator 10 is moved in a wellbore past an anomaly in the casing, such as a casing collar, casing collar locator 10 senses a change in the magnetic field. When the magnetic field through the coil 12 changes, a voltage drop is produced across the coil 12. The change in voltage is used to power LED light source 16 that generates optical energy in the form of light in the wellbore. In this way, the present invention provides a passive downhole light generating system through the use of a self-contained fiber optic casing collar locator 10.

A laboratory experiment was conducted to demonstrate this embodiment of the present invention. To simulate a change in physical properties of a parameter, a 2⅛" OD metal housing was waved past a casing collar locator 10 having a coil 12. The coil 12 sensed the increase in the magnetic field and the resulting voltage drop was used to power the LED light source 16 from which light was observed. In this way, the measurement of a physical parameter, the parameter being magnetic field, was used to generate the optical energy.

An alternative embodiment may use a small supplemental energy source, such as a bias battery, to supplement the electrical pulse generated by the measurement. The supplemental energy source is used in conjunction with the bias battery to power the light source. This alternate method was also demonstrated in the lab and in a test well. Likewise, to increase power to the light source, a small minimum component circuit similarly may be used to amplify the electrical pulse generated by the measurement of a physical parameter. In a similar embodiment, the electrical pulse generated by the measurement may be used to trigger a small circuit to generate a downhole electrical source that powers the light source.

Figure 3:
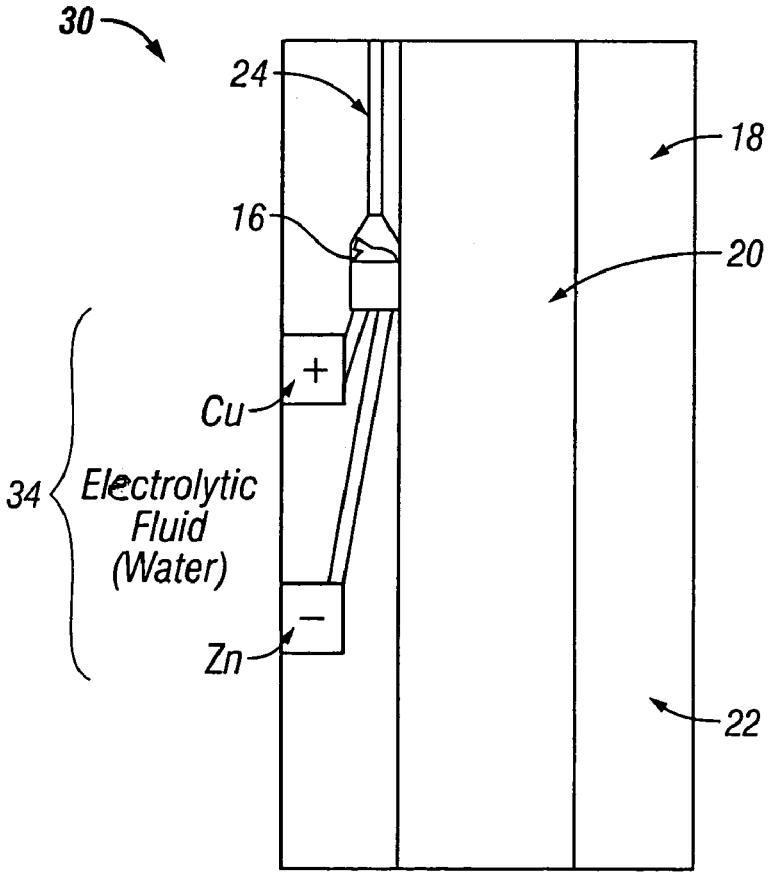
FIG. 3 is a schematic diagram of a fiber optic resistivity detector.

Downhole wells often produce water in addition to oil. Sometimes this water is a weak electrolyte, and at other times it is not. Referring now to FIG. 3, an embodiment is shown in which a change in the chemical properties of a parameter is measured and transformed into optical energy, and in particular a resistivity detector 30 is shown as a light generating transducer. Resistivity detector 30 comprises a housing 18 having an optional flow passage 20 extending through the middle of the housing 18. Such an optional flow passage particularly is useful when the casing collar locator is deployed on coiled tubing. Galvanic cell 34 is connected to the light source 16, the galvanic cell 34 and light source 16 being located in annular space 22 between housing 18 and flow passage 20. The light source 16 connects via the optical waveguide 24 in the annular space 22 to surface measuring and recording equipment, not shown.

Figure 4:
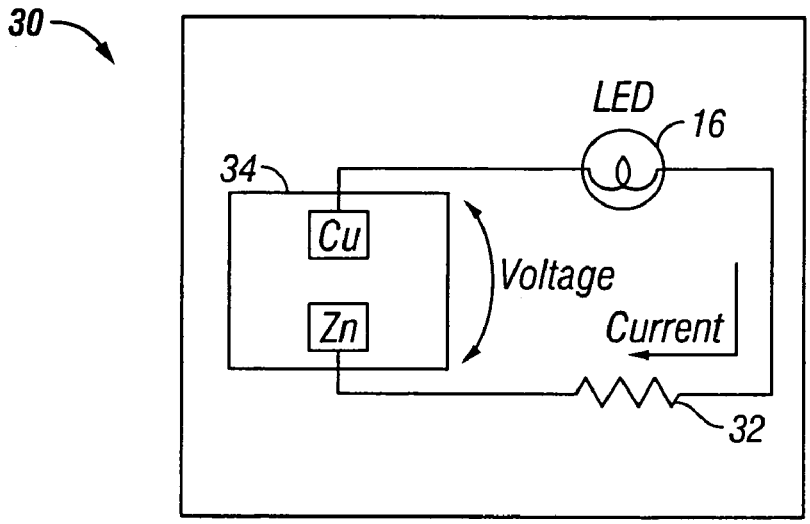
FIG. 4 is a circuit diagram of a fiber optic resistivity detector.

As illustrated in FIG. 4, resistivity detector 30 may include a resistor 32, a galvanic cell 34, and light source 16 shown as a light emitting diode (LED). Galvanic cell 34 comprises two dissimilar metals in an electrolyte, such as acid or saltwater. By choosing the metals appropriately (i.e. one being anodic, the other cathodic), a known voltage differential can be measured across the two surfaces. In the preferred embodiment, zinc (anode) and copper (cathode) are placed in saltwater, thus producing a predictable voltage and a weak current.

For the embodiment shown in FIGS. 3 and 4, the voltage produced from the galvanic cell 34 drives light source 16. Alternatively a small battery, such as a bias battery, may be used to supply the power to fire the light source with the circuit completed by the conductive reservoir fluid. Likewise, to increase power to the light source, a small minimum component circuit similarly may be used to amplify the electrical pulse generated by the measurement of a physical parameter. In a similar embodiment, the electrical pulse generated by the measurement may be used to trigger a small circuit to generate a downhole electrical source that powers the light source.

In some embodiments, an electrolyte coating may be used on galvanic cell plates to increase the sensitivity to water; such coatings are particularly useful if the water being produced by the well is not very conductive. Normally, a galvanic cell produces zero signal for oil, and a maximum signal for water. As with the casing collar locator 10, the resistivity detector 30 is a passive and self-contained device that can differentiate between water and oil, and then send a corresponding signal to equipment at the surface of the ground.

Figure 5:
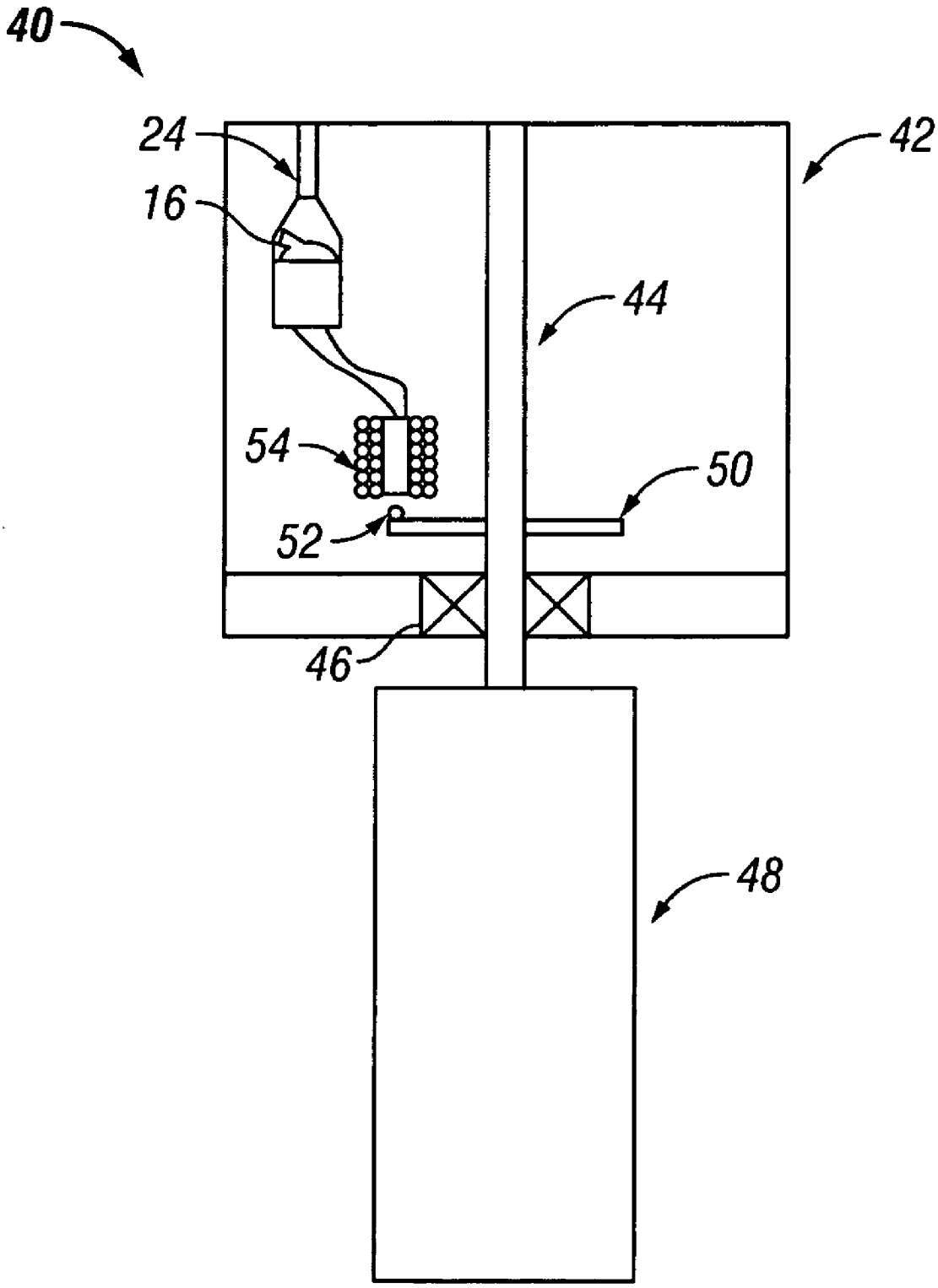
FIG. 5 is a schematic diagram of a fiber optic spinner.

Referring now to FIG. 5, an embodiment is shown in which mechanical motion of a component in a wellbore is used to generate optical energy. In this embodiment, a fiber optic spinner tool 40 is a light generating transducer. The fiber optic spinner tool 40 comprises a housing 42 containing a shaft 44, which passes through bearings and seals 46 mounted in the housing 42. Connected to an end of the shaft 44 is a spinner 48 that turns in response to flowing fluid. Inside housing 42, a mounting disc 50 is connected to the shaft 44. A magnet 52 is connected on an edge of the mounting disc and a wire coil 54 is mounted in the housing 42 just above the magnet 52. Light source 16 connects to the coil 54, and is energized at a frequency that corresponds to a rotational speed (and direction if quadrature is used) of the spinner 48. That is, as the magnet 52 moves past the coil 54, the magnet 52 induces enough voltage and current to energize the LED light source 16, which connects via the optical waveguide 24 to receiving equipment, not shown. In some embodiments, the receiving equipment may be recording equipment disposed at the surface. In certain embodiments, optical waveguide 24 may be disposed within coiled tubing and the spinner tool deployed into the wellbore on coiled tubing.

In this manner, fiber optic spinner tool 40 converts the rotary power of spinner 48, moving in response to fluid flow, to optical energy. Such fluid flow in a wellbore environment may be from a variety of sources. For example, pressured fluid from the surface may be provided in the annulus of the wellbore or through coiled tubing. In some embodiments, fluid flow may be provided via the same coiled tubing string in which optical waveguide 24 is disposed. Alternatively, fluid flow within the well may suffice to rotate spinner 48. For example, fluid flow resulting from the reservoir fluid being at a higher pressure than the wellbore fluid or cross fluid flow within the wellbore between zones may suffice to rotate spinner 48. In other embodiments, fiber optic spinner tool 40 may be moved on a conveyance such as coiled tubing through wellbore fluid, thereby generating the fluid flow to rotate spinner 48.

The present invention comprises methods for generating optical energy in a wellbore by converting a measurement of a physical parameter in a wellbore to optical energy. In some methods, coiled tubing is used to convey the measurement equipment into the wellbore and in some embodiments, a small power source may be used to supplement the power generated by the measurement of the physical parameter. In addition, the present invention comprises a method for measuring parameters in a wellbore and communicating the results using optical energy generated from the transformation of a physical state of a wellbore parameter to optical energy.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A light generating system for use in a wellbore, comprising:

measuring equipment sensitive to optical energy to measure a physical state;

a light generating transducer in the wellbore, the light generating transducer adapted to transform a physical state of a parameter in the wellbore to optical energy;

an optical waveguide for conveying the optical energy from the light generating transducer to receiving equipment for receiving the measurement.

2. The light generating system of claim 1, wherein the physical state is selected from the set consisting of (i) mechanical motion of a component of the wellbore;

(ii) a change in the physical properties of the parameter; and (iii) a change in the chemical properties of the parameter.

3. The light generating system of claim 1, wherein the optical waveguide comprises at least one optical fiber.

4. The light generating system of claim 1, wherein the transformation of the physical state includes a conversion selected from the set consisting of:

(i) a conversion of relative motion of an object to optical energy, the object having a magnetic permeability and electrical conductivity;

(ii) a conversion of rotary power to optical energy, (iii) a conversion of a voltage differential between two dissimilar metals in an electrolyte to optical energy;

(iv) a conversion of an sensed anomaly to optical energy;

(v) a conversion of a change in radiation to optical energy; and (vi) a conversion of movement of a fluid to optical energy.

5. The light generating system of claim 1, wherein transformation of the physical state includes converting movement of a fluid to optical energy, and the source of the fluid movement is one of (i) a pressurized fluid flow supplied from a surface location;

(ii) pressurized fluid flow supplied from the surface via a conduit carrying the optical waveguide to the light generating system;

(iii) reservoir fluid flow at a pressure higher than hydrostatic pressure;

(iv) cross fluid flow in the wellbore; and (v) moving the measuring equipment through wellbore fluid at hydrostatic pressure.

6. The light generating system of claim 1, wherein the parameter is selected from one of (a) conductivity, (b) location of metallic anomalies, (c) fluid flow, and (d) radiation.

7. The light generating system of claim 1, wherein the optical waveguide is disposed within coiled tubing.

8. A method for measuring parameters in a wellbore, comprising the steps of:

providing a light generating transducer in the wellbore, the light generating transducer adapted to transform a physical state of a parameter in the wellbore to optical energy;

transforming the physical state of the parameter in the wellbore to optical energy; and conveying the optical energy from the light generating transducer by means of an optical waveguide to receiving equipment.

9. The method of claim 8 wherein the physical state is selected from the set consisting of:

(i) relative mechanical motion of a component of the wellbore;

(ii) a change in the physical properties of the parameter; and (iii) a change in the chemical properties of the parameter.

10. The method of claim 8 wherein the optical waveguide comprises at least one optical fiber.

11. The method of claim 8 wherein the step of transforming a physical state of a parameter includes a conversion selected from the set consisting of:

(i) converting relative motion of a casing collar to optical energy;

(ii) converting rotary power to optical energy; and (iii) converting a voltage differential between two dissimilar metals in an electrolyte to optical energy.

12. The method of claim 8, wherein the step of transforming includes moving the transducer through fluid in the wellbore.

13. The method of claim 8, wherein the step of transforming includes the movement of a fluid into optical energy and the source of the fluid is selected from the group of:

(i) a pressurized fluid supplied from a surface location;

(ii) pressurized fluid supplied from the surface via a conduit carrying the optical waveguide to the light generating system;

(iii) wellbore fluid at hydrostatic pressure;

(iv) reservoir fluid at a pressure higher than hydrostatic pressure; and (v) cross flow fluid in the wellbore.

14. The method of claim 8 wherein the parameter is selected from one of (a) conductivity, (b) location of metallic anomalies, and (c) fluid flow.

15. The method of claim 8 wherein the optical waveguide is disposed within coiled tubing.

16. A method for generating optical energy in a wellbore, the method comprising the steps of:

conveying measuring equipment sensitive to optical energy for measuring a physical state in a wellbore;

measuring a physical state of a parameter using the conveyed equipment; and using a light generating transducer for transforming the measurement of the physical parameter to optical energy;

wherein the step of transforming is powered by the measurement of the physical parameter.

17. The method of claim 16 further comprising conveying the optical energy from the light generating transducer by means of an optical waveguide to receiving equipment.

18. The method of claim 16 wherein the measurement equipment is conveyed using coiled tubing and the optical waveguide is disposed within the coiled tubing.

19. The method of claim 16, further comprising conveying a power source into a wellbore and combining power from the power source with power from the measurement of the physical parameter to transform the measurement to optical energy.

20. The method of claim 16, further comprising conveying a circuit to amplify the power from the measurement of the physical parameter.

* * * * *